US007385569B2

(12) United States Patent
Chen et al.

(10) Patent No.: US 7,385,569 B2
(45) Date of Patent: Jun. 10, 2008

(54) DRIVING CIRCUIT OF PLASMA DISPLAY PANEL

(75) Inventors: Bi-Hsien Chen, Ping-Tung Hsien (TW); Shin-Chang Lin, Taipei Hsien (TW); Yi-Min Huang, Taipei (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 197 days.

(21) Appl. No.: 11/425,720

(22) Filed: Jun. 22, 2006

(65) Prior Publication Data

US 2006/0290608 A1 Dec. 28, 2006

Related U.S. Application Data

(60) Provisional application No. 60/595,306, filed on Jun. 22, 2005.

(51) Int. Cl.
*G09G 3/28* (2006.01)

(52) U.S. Cl. ..... 345/66; 345/63

(58) Field of Classification Search ..... 345/37, 345/41, 42, 60, 63, 66, 211; 313/567; 315/169.3, 315/169.4

See application file for complete search history.

(56) References Cited

U.S. PATENT DOCUMENTS

| | | | | |
|---|---|---|---|---|
| 5,828,353 | A | 10/1998 | Kishi et al. | |
| 6,781,322 | B2 * | 8/2004 | Onozawa et al. | 315/169.3 |
| 6,933,679 | B2 * | 8/2005 | Lee et al. | 315/169.4 |
| 7,176,854 | B2 * | 2/2007 | Lee et al. | 345/60 |
| 2004/0012546 | A1 * | 1/2004 | Takagi et al. | 345/60 |
| 2004/0104866 | A1 * | 6/2004 | Sano et al. | 345/60 |
| 2005/0179621 | A1 * | 8/2005 | Kang et al. | 345/60 |

* cited by examiner

*Primary Examiner*—Ricardo Osorio
(74) *Attorney, Agent, or Firm*—Winston Hsu

(57) ABSTRACT

A plasma display panel driving circuit includes a panel capacitor having first and second sides; a first switch electrically connected between a first voltage and the first side of the panel capacitor; a second switch electrically connected between a second voltage and a first node; a third switch electrically connected between a third voltage and the first side of the panel capacitor; a fourth switch electrically connected between a fourth voltage and the first node; an energy recovery circuit electrically connected between the first side of the panel capacitor and the first node; a fifth switch electrically connected between the first node and a second node; a sixth switch connected between a fifth voltage and the second node; a voltage source connected between the second node and a third node; and a scan IC. The driving circuit can produce driving waveforms that do not need to stay at ground potential.

22 Claims, 13 Drawing Sheets

DRIVING CIRCUIT OF PLASMA DISPLAY PANEL

CROSS REFERENCE TO RELATED APPLICATIONS

This application claims the benefit of the filing date of U.S. provisional patent application No. 60/595,306, filed Jun. 22, 2005, the contents of which are hereby incorporated by reference.

BACKGROUND OF THE INVENTION

1. Field of the Invention

The present invention relates to a driving circuit, and more specifically, to a driving circuit for a plasma display panel (PDP).

2. Description of the Prior Art

In recent years, there has been an increasing demand for planar matrix displays such as plasma display panels (PDP), liquid-crystal displays (LCD) and electroluminescent displays (EL display) in place of cathode ray tube terminals (CRT) due to the advantage of the thin appearance of the planar matrix displays.

In a PDP display, charges are accumulated according to display data, and a sustaining discharge pulse is applied to paired electrodes in order to initiate discharge glow for display. As far as the PDP display is concerned, it is required to apply a high voltage to the electrodes. In particular, a pulse-duration of several microseconds is usually adopted. Hence the power consumption of the PDP display is quite considerable. Energy recovering (power saving) is therefore sought for. Many designs and patents have been developed for providing methods and apparatuses of energy recovering for PDPs.

Please refer to FIG. 1. FIG. 1 is a block diagram of a prior art driving circuit 100. An equivalent capacitor of a plasma display panel is marked as Cp. The conventional driving circuit 100 includes four switches S1 to S4 for passing current, an X-side energy recovery circuit 110 and a Y-side energy recovery circuit 120 for charging/discharging the panel equivalent capacitor Cp from the X side of the panel equivalent capacitor Cp and the Y side of the panel equivalent capacitor Cp respectively. S5, S6, S7 and S8 are switches for passing current. D5, D6, D7 and D8 are diodes. Va and Vb are two voltage sources. C1 and C2 are capacitors adopted for recovering energy, and L1 and L2 are resonant inductors. The X-side energy recovery circuit 110 includes an energy-forward channel comprising the switch S6, the diode D6 and the inductor L1, and an energy-backward channel comprising the inductor L1, the diode D5 and the switch S5. Similarly, the Y-side energy recovery circuit 120 also includes an energy-forward channel comprising the switch S8, the diode D8 and the inductor L2, and an energy-backward channel comprising the inductor L2, the diode D7 and the switch S7.

Please refer to FIG. 2. FIG. 2 is a flowchart of generating the sustaining pulses of the panel equivalent capacitor Cp of the PDP by the conventional driving circuit 100 illustrated in FIG. 1.

Step 200: Start;

Step 210: Keep the voltage potentials at the X side and the Y side of the panel equivalent capacitor Cp at ground by turning on the switches S3 and S4;

Step 220: Charge the X side of the panel equivalent capacitor Cp by the capacitor C1 and keep the voltage potential at the Y side of the panel equivalent capacitor Cp at ground by turning on the switches S6 and S4; wherein the voltage potential at the X side of the panel equivalent capacitor Cp goes up to Va accordingly;

Step 230: Supply charge to the panel equivalent capacitor Cp of the PDP from the X side by turning on the switches S1 and S4; wherein the voltage potential at the X side of the panel equivalent capacitor Cp keeps at Va and the voltage potential at the Y side of the panel equivalent capacitor Cp keeps at ground accordingly;

Step 240: Discharge the panel equivalent capacitor Cp from the X side and keep the voltage potential at the Y side of the panel equivalent capacitor Cp at ground by turning on the switches S5 and S4; wherein the voltage potential at the X side of the panel equivalent capacitor Cp goes down to ground accordingly;

Step 250: Keep the voltage potentials at the X side and the Y side of the panel equivalent capacitor Cp at ground by turning on the switches S3 and S4;

Step 260: Charge the Y side of the panel equivalent capacitor Cp by the capacitor C2 and keep the voltage potential at the X side of the panel equivalent capacitor Cp at ground by turning on the switches S8 and S3; wherein the voltage potential at the Y side of the panel equivalent capacitor Cp goes up to Vb accordingly;

Step 270: Supply charge to the panel equivalent capacitor Cp of the PDP from the Y side by turning on the switches S2 and S3; wherein the voltage potential at the Y side of the panel equivalent capacitor Cp keeps at Vb and the voltage potential at the X side of the panel equivalent capacitor Cp keeps at ground accordingly;

Step 280: Discharge the panel equivalent capacitor Cp from the Y side and keep the voltage potential at the X side of the panel equivalent capacitor Cp at ground by turning on the switches S7 and S3; wherein the voltage potential at the Y side of the panel equivalent capacitor Cp goes down to ground accordingly;

Step 290: Keep the voltage potentials at the X side and the Y side of the panel equivalent capacitor Cp at ground by turning on the switches S3 and S4;

Step 295: End.

Please refer to FIG. 3. FIG. 3 shows a diagram illustrating the voltage potentials at the X side and the Y side of the panel equivalent capacitor Cp, and the control signals, M1 to M8, of the switches S1 to S8 in FIG. 1 respectively. In FIG. 3, the horizontal axis represents the time, while the vertical axis represents the voltage potential. Note that the switches S1 to S8 are designed to close (turned on) for passing current when the control signal is high, and to open (turned off) such that no current can pass when the control signal is low.

Please refer to FIG. 4. FIG. 4 shows another prior art driving circuit 400. The driving circuit 400 shown in FIG. 4 is also known as the Further Improvement of Energy Recovery Capacitor Elimination in T-shape ENergy REcovery Circuit (fierce tenrec), which is disclosed in U.S. patent application Ser. No. 10/908,610, the contents of which are hereby incorporated by reference in its entirety. The driving circuit 400 contains an energy recovery circuit 410, switches S11 to S17, an inductor L11, voltage sources Vc, Vd, Ve, and Vf, and equivalent capacitor of a plasma display panel $C_p$. This driving circuit can make the waveforms in sustain period.

Conventionally, the energy recovery (power saving) circuit provides two individual channels of charging and discharging the equivalent capacitor respectively (energy-forward channel and energy-backward channel) for each side of the panel equivalent capacitor Cp. Therefore, the amount of required components is quite large. Furthermore, the area of capacitors C1 and C2 is usually considerable. Hence the cost of energy recovery circuit is not easy to reduce.

SUMMARY OF THE INVENTION

It is therefore an objective of the invention to provide plasma display panel driving circuits that solve the problems of the prior art.

According to a preferred embodiment of the present invention, a claimed plasma display panel driving circuit includes a panel equivalent capacitor having a first side and a second side; a first switch electrically connected between a first voltage source and the first side of the panel equivalent capacitor; a second switch electrically connected between a second voltage source and a first node; a third switch electrically connected between a third voltage source and the first side of the panel equivalent capacitor; a fourth switch electrically connected between a fourth voltage source and the first node; an energy recovery circuit electrically connected between the first side of the panel equivalent capacitor and the first node; a fifth switch electrically connected between the first node and a second node; a sixth switch electrically connected between a fifth voltage source and the second node; a sixth voltage source electrically connected between the second node and a third node; and a scan IC comprising: a high-side switch electrically connected between the third node and the second side of the panel equivalent capacitor; and a low-side switch electrically connected between the second side of the panel equivalent capacitor and the second node.

According to another preferred embodiment of the present invention, a claimed plasma display panel driving circuit includes a panel equivalent capacitor having a first side and a second side; a first switch electrically connected between a first voltage source and the first side of the panel equivalent capacitor; an energy recovery circuit electrically connected between the first side of the panel equivalent capacitor and a first node; a second switch electrically connected between a second voltage source and a second node; a third switch electrically connected between a third voltage source and the first side of the panel equivalent capacitor; a fourth switch electrically connected between a fourth voltage source and the first node; a fifth switch electrically connected between a fifth voltage source and the second node; a sixth voltage source electrically connected between the second node and a third node; and a scan IC comprising: a high-side switch electrically connected between the third node and the second side of the panel equivalent capacitor; and a low-side switch electrically connected between the second side of the panel equivalent capacitor and the second node.

These and other objectives of the present invention will no doubt become obvious to those of ordinary skill in the art after reading the following detailed description of the preferred embodiment that is illustrated in the various figures and drawings.

DETAILED DESCRIPTION

The present invention provides a driving waveform and circuit for a PDP. The main idea of this invention is that the circuit can make the waveforms for PDP display in each period, and does not merely focus on sustain period. The advantages of this invention are that the fewer components can be used to create the driving waveforms, and the cost of circuit can be lowered accordingly.

Figure 1:
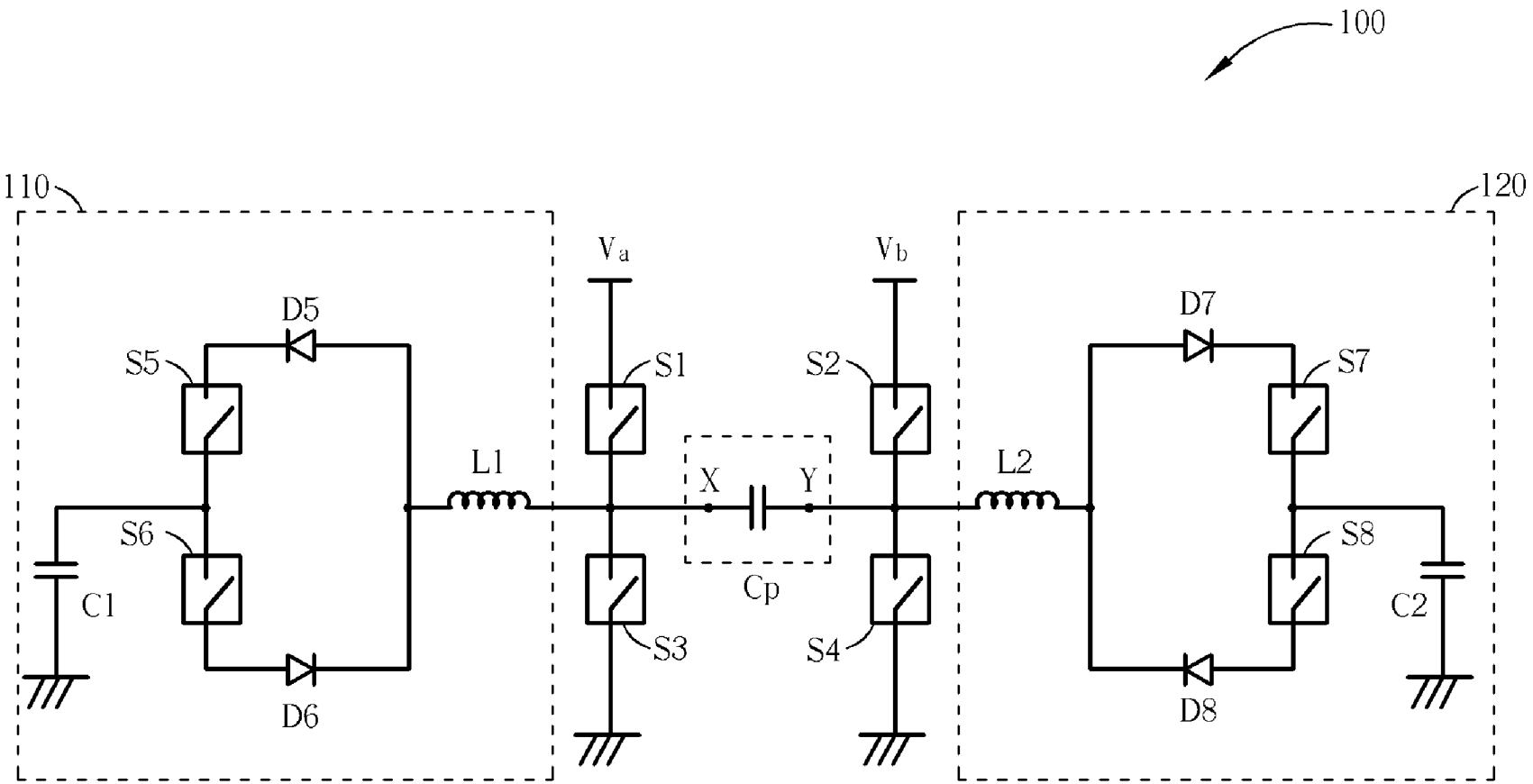
Fig. 1 Prior art
FIG. 1 is a circuit diagram of a prior art energy recovery circuit with an equivalent capacitor of a PDP.
Figure 2:
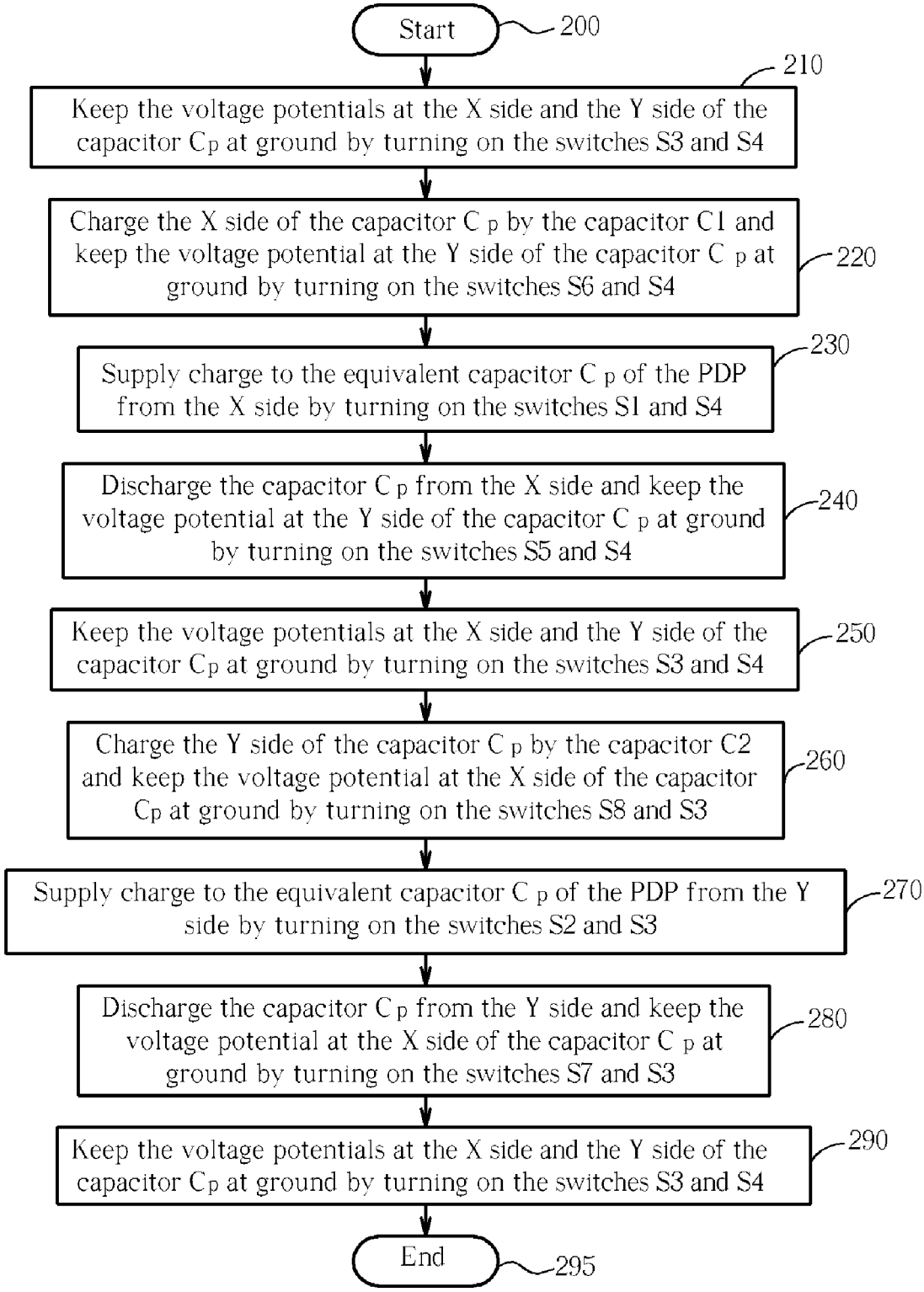
Fig. 2 Prior art
FIG. 2 is a flowchart of a prior art method of generating the sustaining pulses of the panel equivalent capacitor Cp.
Figure 3:
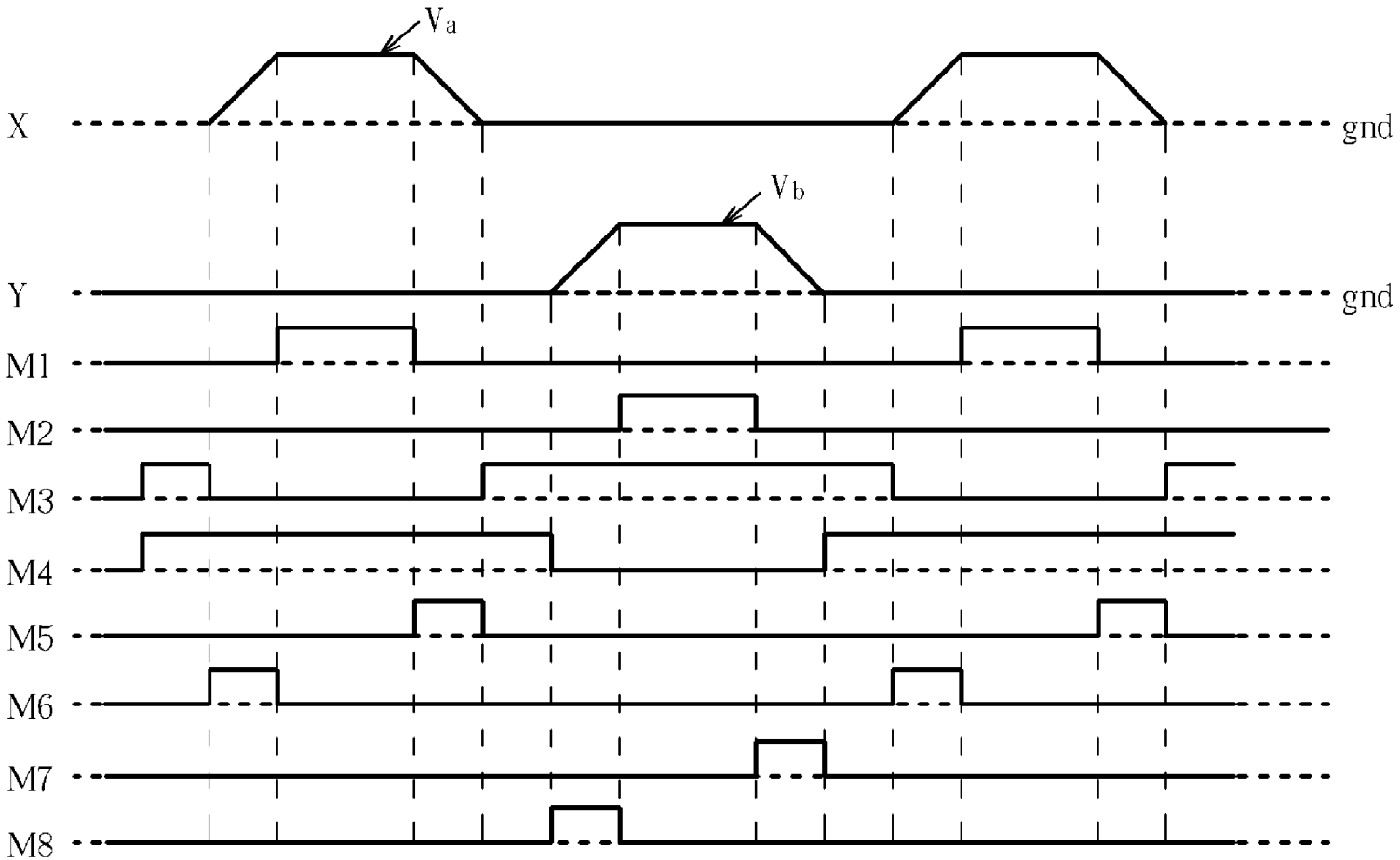
Fig. 3 Prior art
FIG. 3 is a diagram illustrating the voltage potentials at sides of the panel equivalent capacitor Cp and the control signals of the switches.
Figure 4:
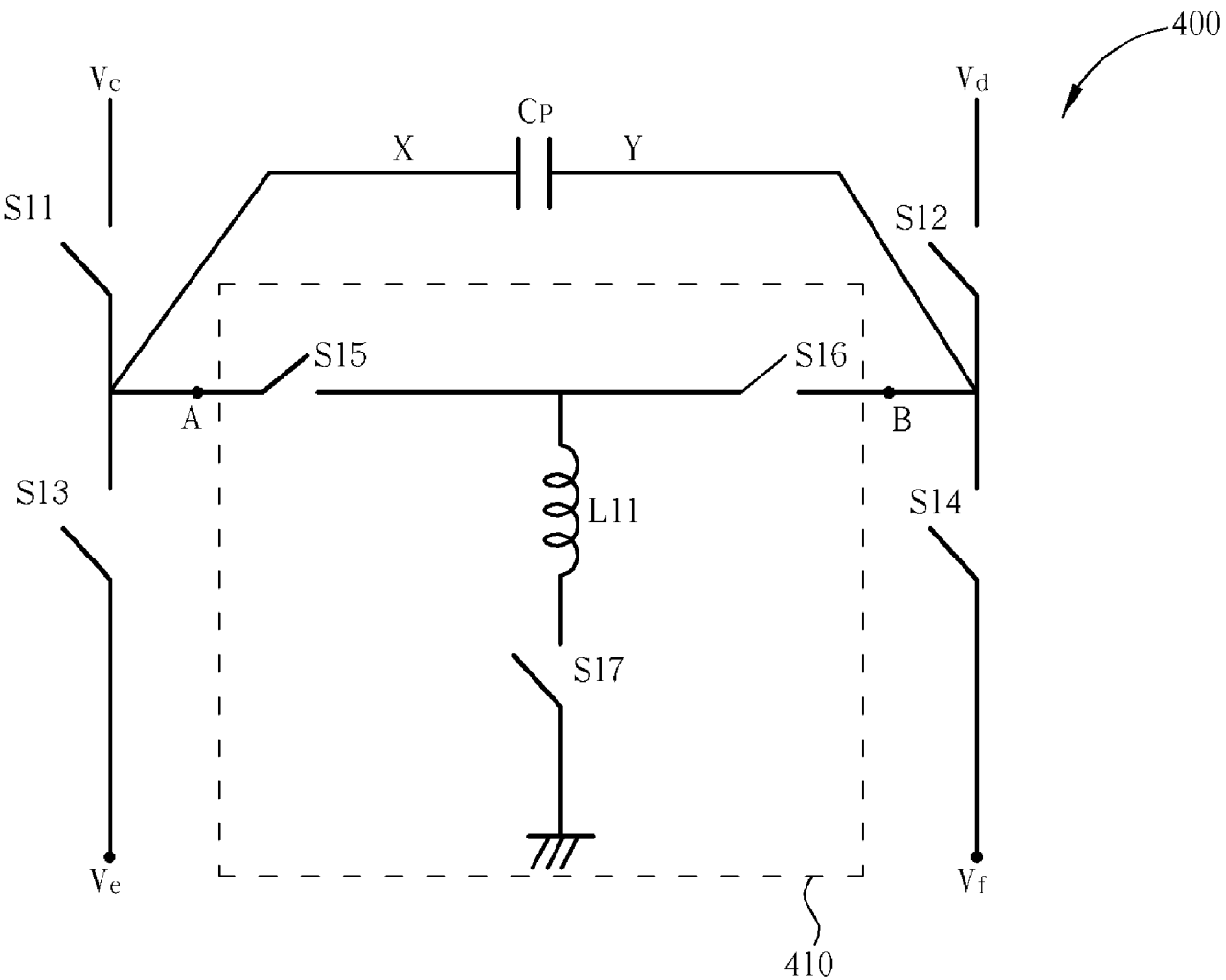
Fig. 4 Prior Art
FIG. 4 shows another prior art driving circuit.
Figure 5:
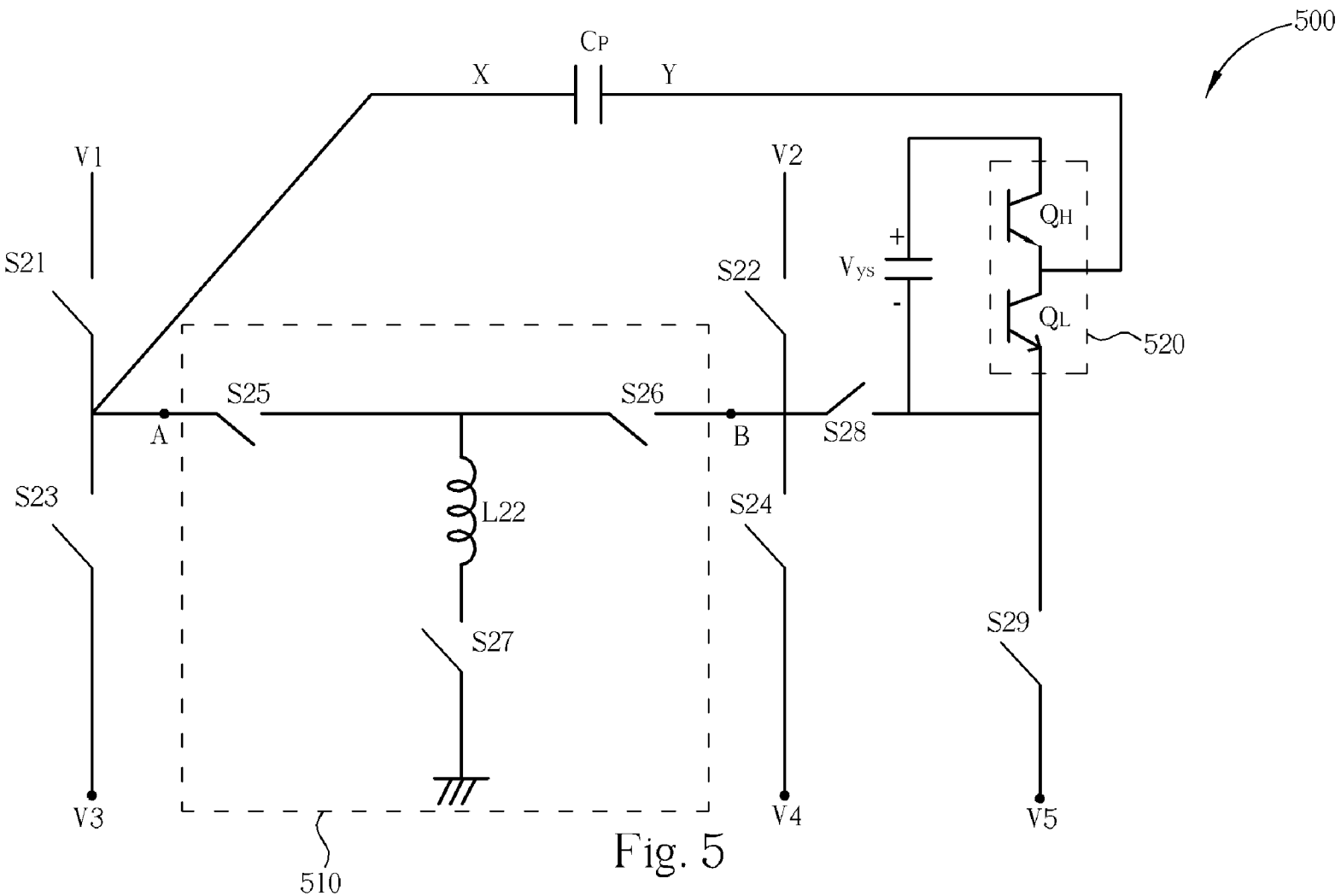
FIG. 5 shows a circuit diagram of a plasma display panel driving circuit according to an embodiment of the present invention.

Please refer to FIG. 5. FIG. 5 shows a circuit diagram of a plasma display panel driving circuit 500 according to an embodiment of the present invention. The driving circuit 500 comprises switches S21 to S29. High-side and low-side switches are realized through transistors $Q_H$ and $Q_L$ that are in a scan IC 520. The display panel driving circuit 500 also comprises an inductor L22, an equivalent capacitor of a PDP $C_p$, and five voltage sources V1 to V5. A voltage source Vys couples to scan IC 520 in parallel, wherein the positive and negative terminals of Vys couple to $Q_H$ and $Q_L$, respectively. Voltage sources V1 and V2 are positive voltage sources and voltage sources V3 and V4 are negative voltage sources. Voltage sources V1 and V2 can have the same voltage potential or can be different. Likewise, voltage sources V3 and V4 can have the same voltage potential or can be different. The voltage potential of V4 is higher than the voltage potential of V5 and lower than the voltage potential of (V5+Vys). An energy recovery circuit 510 is electrically connected to the display panel driving circuit 500 at nodes A and B, and includes switches S25, S26, S27 and L22, wherein L22 and S27 couple in series.

Figure 6:
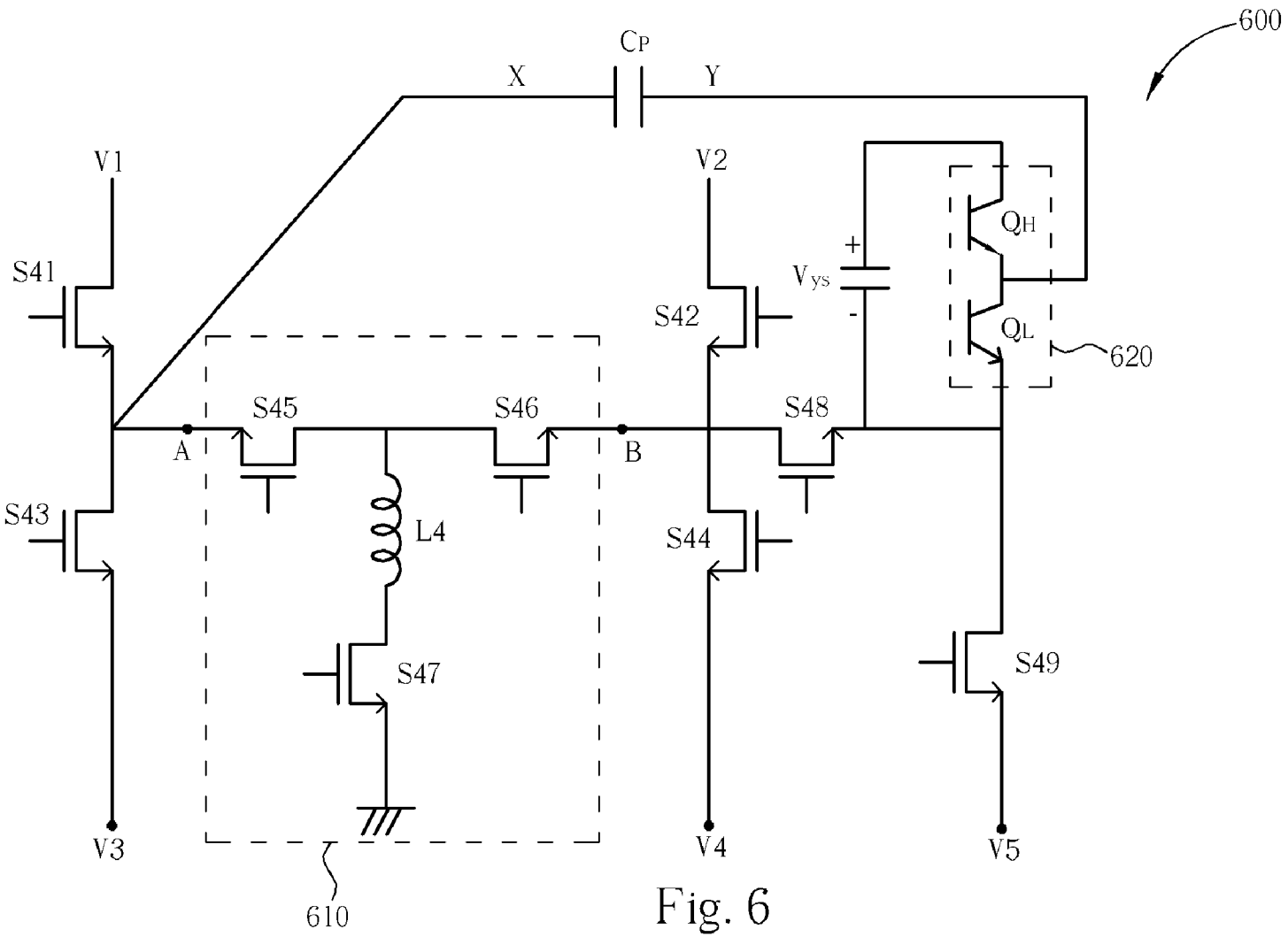
FIG. 6 illustrates a circuit diagram of a plasma display panel driving circuit implemented using MOSFET transistors.

Please refer to FIG. 6. FIG. 6 illustrates a circuit diagram of a plasma display panel driving circuit 600 implemented using MOSFET transistors. The switches S41 to S49 are all n-channel MOSFETs. Energy recovery circuit 610 includes switches S45, S46, S47, and L4 wherein L4 and S47 couple in series. In addition, the scan IC 620 is realized out of two BJT transistors $Q_H$ and $Q_L$ although other types of transistors could also be used.

Figure 7:
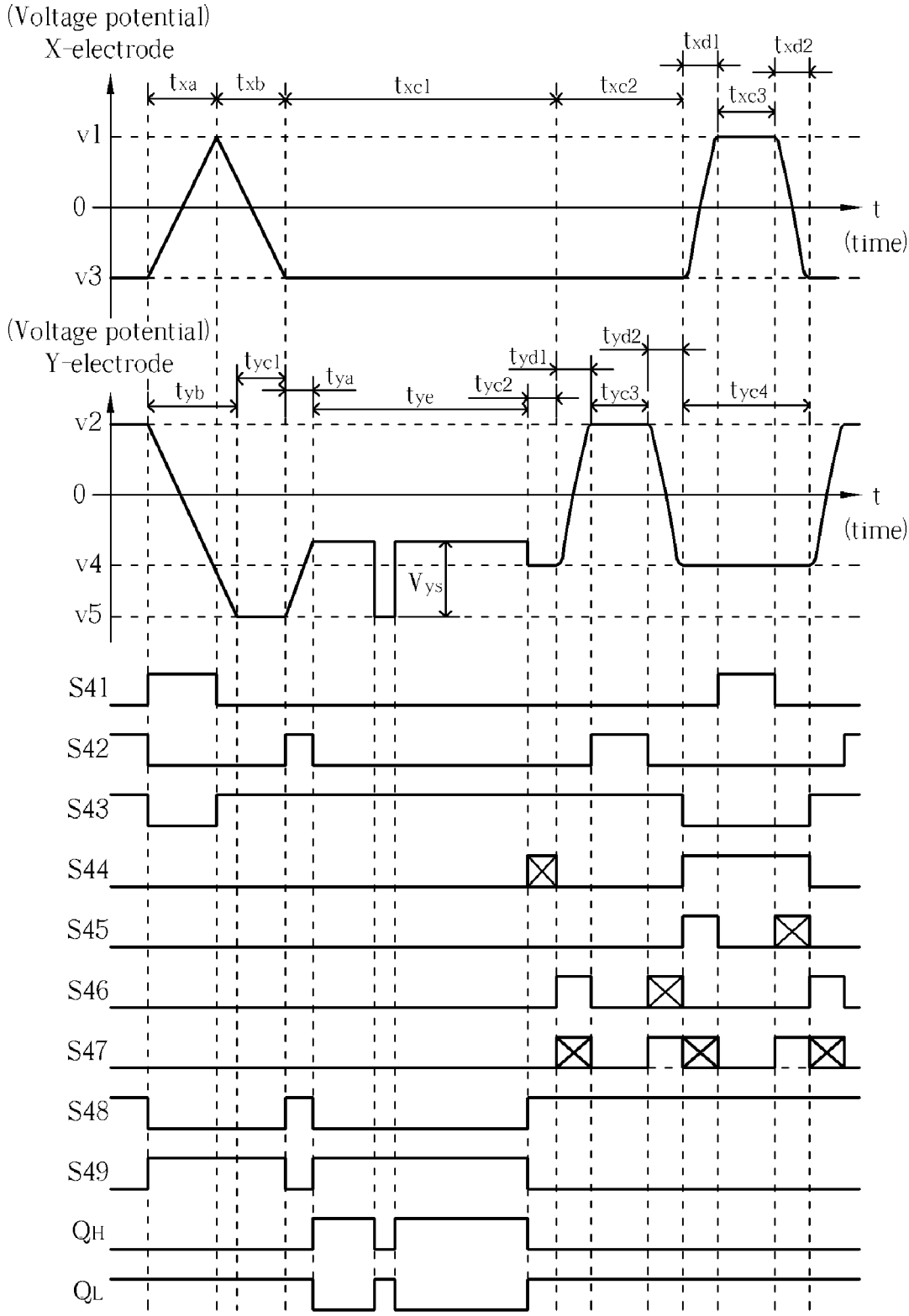
FIG. 7 illustrates the PDP driving waveform.

FIG. 7 illustrates the PDP driving waveform. It can be realized by the driving circuit in FIG. 6. In FIG. 7, the high level of the signals for all switches represents the ON-state of the switches, and the low level of the signals for all switches represents the OFF-state. If the switch can operate in either ON-state or OFF-state, the signals will be marked as X. The switches can either be fully on or act as the large resistors or variable resistors in the ON-state.

There are several different waveforms at the X side of the panel equivalent capacitor Cp. The operations are as follows. Please refer to FIG. 6 and FIG. 7 for examples.

Positive ramp or exponential waveform (at $t=t_{xa}$)

Charge the X side of the panel equivalent capacitor Cp from low voltage potential to high voltage potential exponentially or linearly by turning on the switch S41. The switch S41 acts as the large resistor or the variable resistor at $t=t_{xa}$ period in FIG. 7.

Negative ramp or exponential waveform (at $t=t_{xb}$)

Discharge the X side of the panel equivalent capacitor Cp from high voltage potential to low voltage potential exponentially or linearly by turning on the switch S43. The switch S43 acts as the large resistor or the variable resistor at $t=t_{xb}$ period in FIG. 7.

Clamping waveform (at $t=t_{xc1}$, $t=t_{xc2}$ and $t=t_{xc3}$)

The X side of the panel equivalent capacitor Cp is clamped to the voltage potential V3 by fully turning on the switch S43 at $t=t_{xc1}$ and $t=t_{xc2}$ periods in FIG. 7. The X side of the panel equivalent capacitor Cp is clamped to the voltage potential V1 by fully turning on the switch S41 at $t=t_{xc3}$ period in FIG. 7. The switches S43 and S41 act as short circuits while they are turned on during these periods.

Energy recovery waveform (at $t=t_{xc2}$, $t=t_{xd1}$, $t=t_{xc3}$ and $t=t_{xd2}$)

At $t=t_{xc2}$ period in FIG. 7, the X side of the panel equivalent capacitor Cp is clamped to the voltage potential V3 by fully turning on the switch S43. The switch S43 acts as a short circuit.

At $t=t_{xd1}$ period in FIG. 7, the X side of the panel equivalent capacitor Cp is charged from V3 to V1 through the components S45, S47 and L4. The switches S45 and S47 are fully on and act as short circuits.

At $t=t_{xc3}$ period in FIG. 7, the X side of the panel equivalent capacitor Cp is clamped to the voltage potential V1 by fully turning on the switch S41. The switch S41 acts as a short circuit.

At $t=t_{xd2}$ period in FIG. 7, the X side of the panel equivalent capacitor Cp is discharged from V1 to V3 through the components S45, S47 and L4. The switches S45 and S47 are fully on and act as short circuits.

There are several different waveforms at the Y side of the panel equivalent capacitor Cp. The operations are as follows. Please refer to FIG. 6 and FIG. 7 for examples.

Positive ramp or exponential waveform (at $t=t_{ya}$)

Charge the Y side of the panel equivalent capacitor Cp from low voltage potential to high voltage potential exponentially or linearly by turning on the switches S42, S48 and $Q_L$ of the scan IC 620 or S42, S48 and $Q_H$ of the scan IC 620. If the path is through the switches S42, S48, and $Q_L$ of the scan IC 620, the highest voltage potential can reach V2. If the path is through the switches S42, S48, $Q_H$ of the scan IC 620 and the voltage potential Vys, the highest voltage potential can reach (V2+Vys). At $t=t_{ya}$ period in FIG. 7, the switch S42 or/and the switch S48 act as the large resistor or the variable resistor.

Negative ramp or exponential waveform (at $t=t_{yb}$)

Discharge the Y side of the panel equivalent capacitor Cp from high voltage potential to low voltage potential exponentially or linearly by turning on the switches S44 and $Q_L$ of the scan IC 620 or the switches S49 and $Q_L$ of the scan IC 620. The switch S44 or the switch S49 acts as the large resistor or the variable resistor at this period. If switch S44 is used, the lowest voltage potential can reach V4. If switch S49 is used, the lowest voltage potential can reach V5. At $t=t_{yb}$ period in FIG. 7, the Y side of the panel equivalent capacitor Cp is pulled down from the voltage potential V2 to the voltage potential V5. The switches S49 and $Q_L$ of the scan IC 620 are turned on and switch S49 acts as the large resistor or variable resistor.

Clamping waveform (at $t=t_{yc1}$, $t=t_{yc2}$, $t=t_{yc3}$ and $t=t_{yc4}$)

The Y side of the panel equivalent capacitor Cp is clamped to the voltage potential V2 by fully turning on the switches S42, S48, and $Q_L$ of the scan IC 620. The Y side of the panel equivalent capacitor Cp is clamped to the voltage potential V4 by fully turning on the switches S44, S48, and $Q_L$ of the scan IC 620. The Y side of the panel equivalent capacitor Cp is clamped to the voltage potential V5 by fully turning on the switches S49 and $Q_L$ of the scan IC 620. The switches S42, S44, S48 and S49 act as short circuits during these periods. At $t=t_{yc1}$, $t=t_{yc2}$, $t=t_{yc3}$ and $t=t_{yc4}$ periods in FIG. 7, the Y side of the panel equivalent capacitor Cp is clamped to the voltage potentials V5, V4, V2 and V4, respectively.

Energy recovery waveform (at $t=t_{yd1}$, $t=t_{yc3}$, $t=t_{yd2}$ and $t=t_{yc4}$)

At $t=t_{yd1}$ period in FIG. 7, the Y side of the panel equivalent capacitor Cp is charged from V4 to V2 through the components S46, S47, S48, $Q_L$ of the scan IC 620 and L4. The switches S46, S47, and S48 are fully on and act as short circuits.

At $t=t_{yc3}$ period in FIG. 7, the Y side of the panel equivalent capacitor Cp is clamped to the voltage potential V2 by fully turning on the switches S42, S48 and $Q_L$ of the scan IC 620. The switches S42 and S48 act as short circuits.

At $t=t_{yd2}$ period in FIG. 7, the Y side of the panel equivalent capacitor Cp is discharged from V2 to V4 through the components S46, S47, S48, $Q_L$ of the scan IC 620 and L4. The switches S46, S47, and S48 are fully on and act as short circuits.

At $t=t_{yc4}$ period in FIG. 7, the Y side of the panel equivalent capacitor Cp is clamped to the voltage potential V4 by fully turning on the switches S44, S48 and $Q_L$ of the scan IC 620. The switches S44 and S48 act as short circuits.

Scanning waveform (at $t=t_{ye}$)

The switch S49 is fully turned on at this period. $Q_H$ of the scan IC 620 is turned on except the period of producing the scan pulse. At the period of producing the scan pulse, $Q_L$ of the scan IC 620 is turned on instead of $Q_H$ of the scan IC 620. Please refer to $t=t_{ye}$ period in FIG. 7.

The waveforms of the X side and the Y side of the panel equivalent capacitor Cp in FIG. 7 can be rearranged according to the required timing or waveform shapes.

Figure 8:
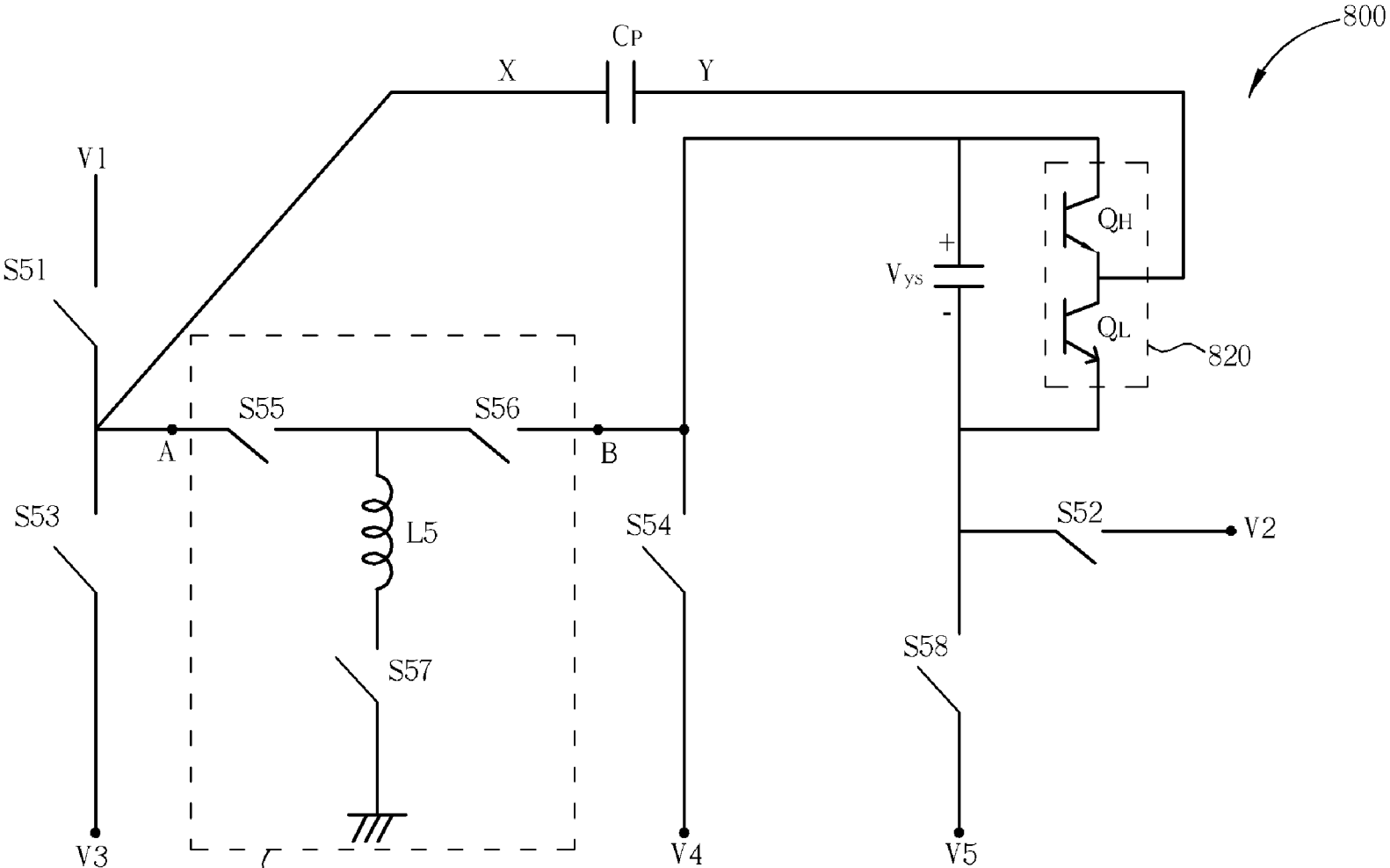
FIG. 8 shows a circuit diagram of a plasma display panel driving circuit according to an embodiment of the present invention.

Please refer to FIG. 8. FIG. 8 shows a circuit diagram of a plasma display panel driving circuit 800 according to an embodiment of the present invention. The driving circuit 800 comprises switches S51 to S58. High-side and low-side switches are realized through transistors $Q_H$ and $Q_L$ that are in a scan IC 820. The display panel driving circuit 800 also comprises an inductor L5, an equivalent capacitor of a PDP $C_p$, and five voltage sources V1 to V5. A voltage source Vys couples to scan IC 820 in parallel, wherein the positive and negative terminals of Vys couple to $Q_H$ and $Q_L$, respectively. Voltage sources V1 and V2 are positive voltage sources and voltage sources V3 and V4 are negative voltage sources. Voltage sources V1 and V2 can have the same voltage potential or can be different. Likewise, voltage sources V3 and V4 can have the same voltage potential or can be different. The voltage potential of V4 is higher than the voltage potential of V5 and lower than the voltage potential of (V5+Vys). An energy recovery circuit 810 is electrically connected to the display panel driving circuit 800 at nodes A and B, and includes switches S55, S56, S57 and L5, wherein L5 and S57 couple in series.

Figure 9:
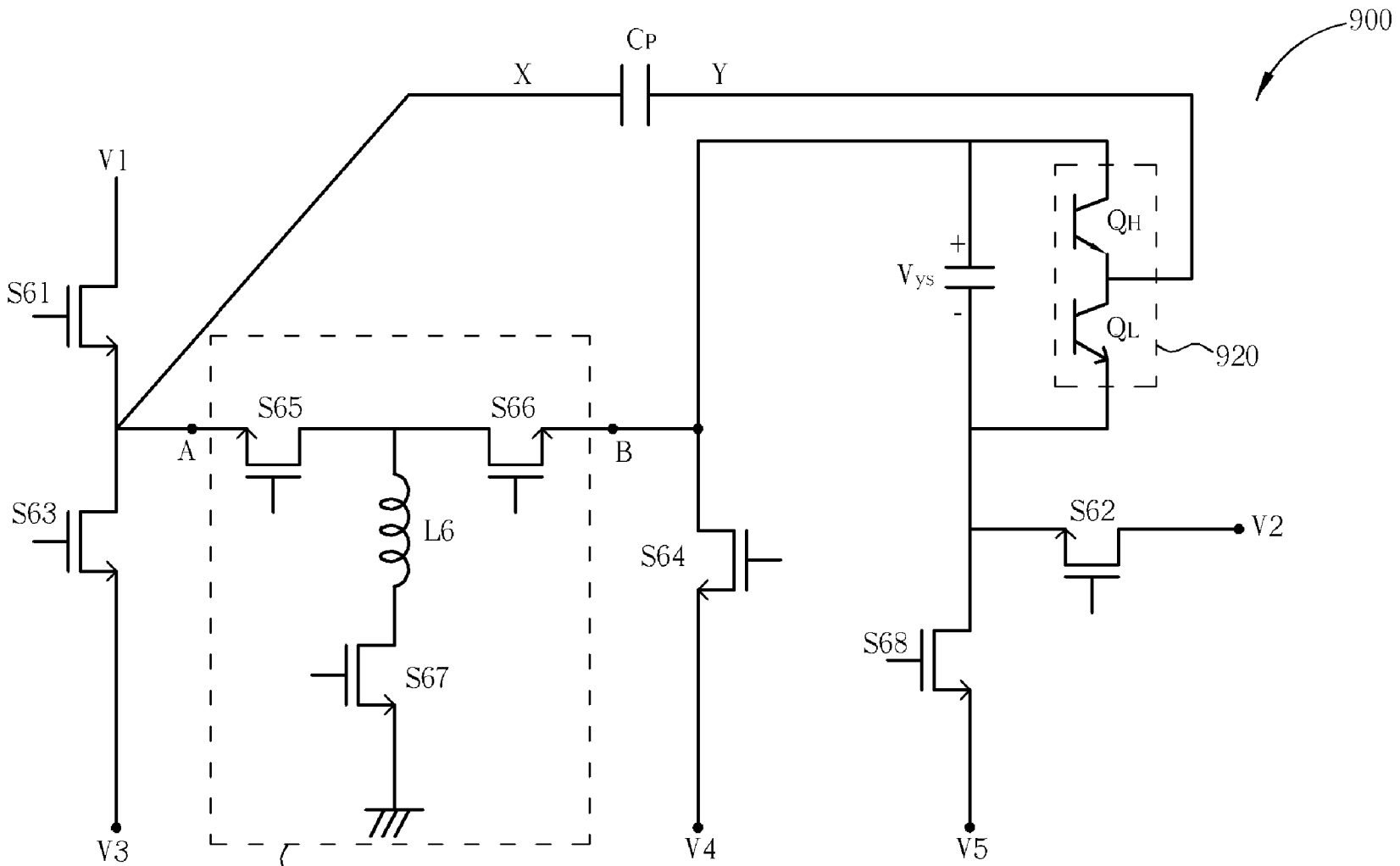
FIG. 9 illustrates a circuit diagram of a plasma display panel driving circuit implemented using MOSFET transistors.

Please refer to FIG. 9. FIG. 9 illustrates a circuit diagram of a plasma display panel driving circuit 900 implemented using MOSFET transistors. The switches S61 to S68 are all n-channel MOSFETs. Energy recovery circuit 910 includes switches S65, S66, S67, and L6 wherein L6 and S67 couple in series. In addition, the scan IC 920 is realized out of two BJT transistors $Q_H$ and $Q_L$ although other types of transistors could also be used.

Figure 10:
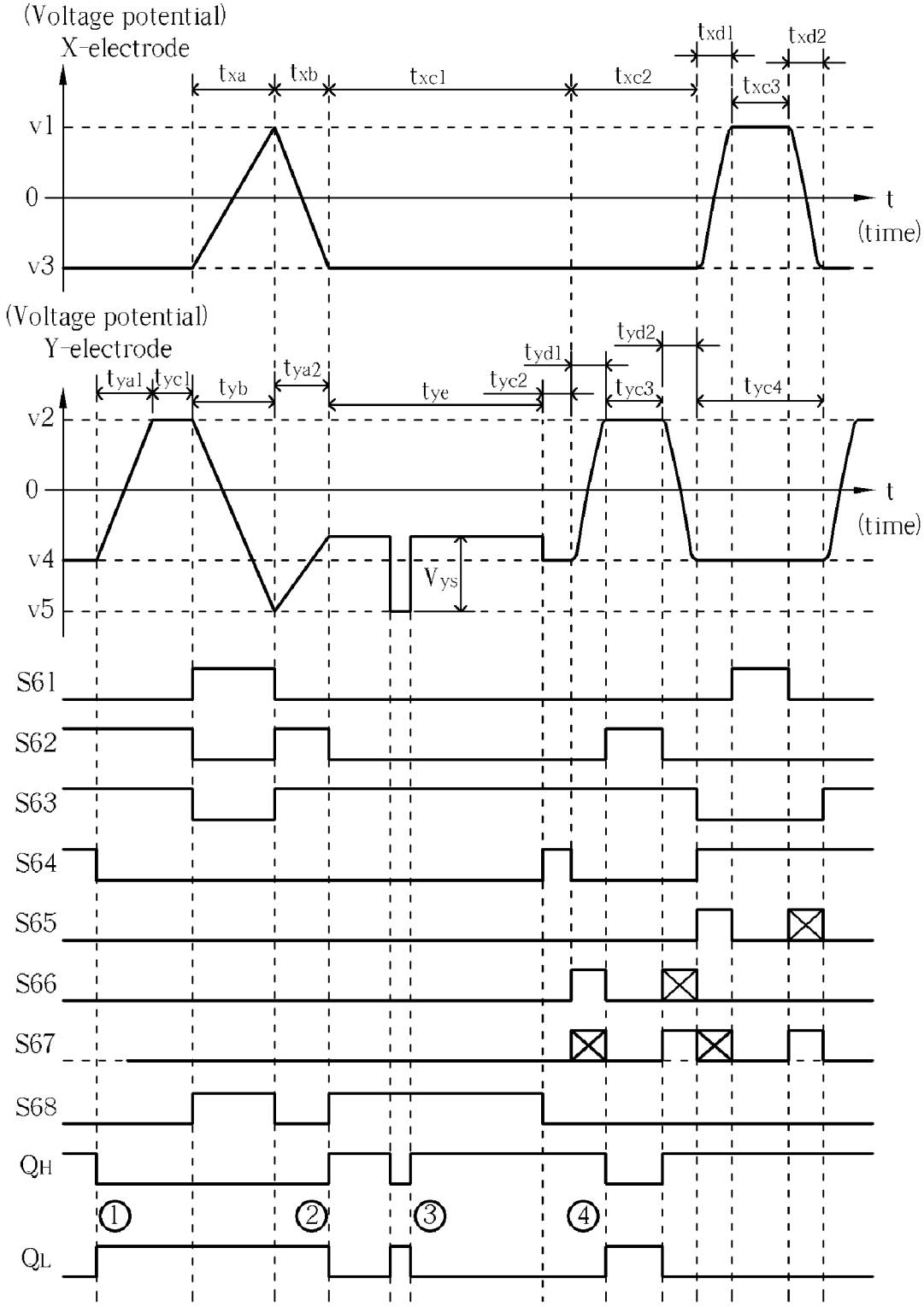
FIG. 10 illustrates the PDP driving waveform.

FIG. 10 illustrates the PDP driving waveform. It can be realized by FIG. 9. In FIG. 10, the high level of the signals for all switches represents the ON-state, and the low level of the signals for all switches represents the OFF-state. If the switch can operate in either ON-state or OFF-state, the signals will be marked as X. The switches can either be fully on or act as the large resistors or variable resistors in ON-state.

There are several different waveforms at the X side of the panel equivalent capacitor Cp. The operations are as follows. Please refer to FIG. 9 and FIG. 10 for examples.

Positive ramp or exponential waveform (at $t=t_{xa}$)

Charge the X side of the panel equivalent capacitor Cp from low voltage potential to high voltage potential exponentially or linearly by turning on the switch S61. The switch S61 acts as the large resistor or the variable resistor in $t=t_{xa}$ period in FIG. 10.

Negative ramp or exponential waveform (at $t=t_{xb}$)

Discharge the X side of the panel equivalent capacitor Cp from high voltage potential to low voltage potential exponentially or linearly by turning on the switch S63. The switch S63 acts as the large resistor or the variable resistor at $t=t_{xb}$ period in FIG. 10.

Clamping waveform (at $t=t_{xc1}$, $t=t_{xc2}$ and $t=t_{xc3}$)

The X side of the panel equivalent capacitor Cp is clamped to the voltage potential V3 by fully turning on the switch S63 at $t=t_{xc1}$ and $t=t_{xc2}$ periods in FIG. 10. The X side of the panel equivalent capacitor Cp is clamped to the voltage potential V1 by fully turning on the switch S61 at $t=t_{xc3}$ period in FIG. 10. The switches S63 and S61 act as short circuits during these periods.

Energy recovery waveform (at $t=t_{xc2}$, $t=t_{xd1}$, $t=t_{xc3}$ and $t=t_{xd2}$)

At $t=t_{xc2}$ period in FIG. 10, the X side of the panel equivalent capacitor Cp is clamped to the voltage potential V3 by fully turning on the switch S63. The switch S63 acts as a short circuit.

At $t=t_{xd1}$ period in FIG. 10, the X side of the panel equivalent capacitor Cp is charged from V3 to V1 through the components S65, S67 and L6. The switches S65 and S67 are fully on and act as short circuits.

At $t=t_{xc3}$ period in FIG. 10, the X side of the panel equivalent capacitor Cp is clamped to the voltage potential V1 by fully turning on the switch S61. The switch S61 acts as a short circuit.

At $t=t_{xd2}$ period in FIG. 10, the X side of the panel equivalent capacitor Cp is discharged from V1 to V3 through the components S65, S67 and L6. The switches S65 and S67 are fully on and act as short circuits.

There are several different waveforms at the Y side of the panel equivalent capacitor Cp. The operations are as follows. Please refer to FIG. 9 and FIG. 10 for examples.

Positive ramp or exponential waveform (at $t=t_{ya1}$ and $t=t_{ya2}$)

Charge the Y side of the panel equivalent capacitor Cp from low voltage potential to high voltage potential exponentially or linearly by turning on the switches S62 and $Q_L$ or the switches S62 and $Q_H$ of scan IC 920. If the path is through the switches S62 and $Q_L$ of scan IC 920, the highest voltage potential can reach V2. If the path is through the switches S62 and $Q_H$ of scan IC 920 and the voltage potential Vys, the highest voltage potential can reach (V2+Vys). At $t=t_{ya1}$ and $t=t_{ya2}$ periods in FIG. 10, the switch S62 acts as the large resistor or the variable resistor.

Negative ramp or exponential waveform (at $t=t_{yb}$)

Discharge the Y side of the panel equivalent capacitor Cp from high voltage potential to low voltage potential exponentially or linearly by turning on the switches S64 and $Q_H$ of scan IC 920 or the switches S68 and $Q_L$ of scan IC 920. The switch S64 or the switch S68 acts as the large resistor or the variable resistor at this period. If switch S64 is used, the lowest voltage potential can reach V4. If switch S68 is used, the lowest voltage potential can reach V5. At $t=t_{yb}$ period in FIG. 10, the Y side of the panel equivalent capacitor Cp is pulled down from the voltage potential V2 to the voltage potential V5. The switches S68 and $Q_L$ of scan IC 920 are turned on and switch S68 acts as the large resistor or the variable resistor.

Clamping waveform (at $t=t_{yc1}$, $t=t_{yc2}$, $t=t_{yc3}$ and $t=t_{yc4}$)

The Y side of the panel equivalent capacitor Cp is clamped to the voltage potential V2 by fully turning on the switches S62 and $Q_L$ of scan IC 920. The Y side of the panel equivalent capacitor Cp is clamped to the voltage potential V4 by fully turning on the switches S64 and $Q_H$ of scan IC 920. The Y side of the panel equivalent capacitor Cp is clamped to the voltage potential V5 by fully turning on the switches S68 and $Q_L$ of scan IC 920. The switches S62, S64 and S68 act as short circuits during these periods. At $t=t_{yc1}$, $t=t_{yc2}$, $t=t_{yc3}$ and $t=t_{yc4}$ periods in FIG. 10, the Y side of the panel equivalent capacitor Cp is clamped to the voltage potentials V2 and V4, respectively.

Energy recovery waveform (at $t=t_{yd1}$, $t=t_{yc3}$, $t=t_{yd2}$ and $t=t_{yc4}$)

At $t=t_{yd1}$ period in FIG. 10, the Y side of the panel equivalent capacitor Cp is charged from V4 to V2 through the components S66, S67, $Q_H$ of scan IC 920 and L6. The switches S66 and S67 are fully on and act as short circuits.

At $t=t_{yc3}$ period in FIG. 10, the Y side of the panel equivalent capacitor Cp is clamped to the voltage potential V2 by fully turning on the switches S62 and $Q_L$ of scan IC 920. The switch S62 acts as a short circuit.

At $t=t_{yd2}$ period in FIG. 10, the Y side of the panel equivalent capacitor Cp is discharged from V2 to V4 through the components S66, S67, $Q_H$ of scan IC 920 and L6. The switches S66 and S67 are fully on and act as short circuits.

At $t=t_{yc4}$ period in FIG. 10, the Y side of the panel equivalent capacitor Cp is clamped to the voltage potential V4 by fully turning on the switches S64 and $Q_H$ of scan IC 920. The switch S64 acts as a short circuit.

The switching of scan IC 920 at this period is soft switching and $Q_H$ and $Q_L$ of scan IC 920 operate in zero voltage switching (ZVS).

Scanning waveform (at $t=t_{ye}$)

The switch S68 is fully turned on at this period. $Q_H$ of scan IC 920 is turned on except the period of producing the scan pulse. At the period of producing the scan pulse, $Q_L$ of scan IC 920 is turned on instead of $Q_H$ of scan IC 920. Please refer to $t=t_{ye}$ period in FIG. 10.

The waveforms of the X side and the Y side of the panel equivalent capacitor Cp in FIG. 10 can be rearranged according to the required timing or waveform shapes.

Figure 11:
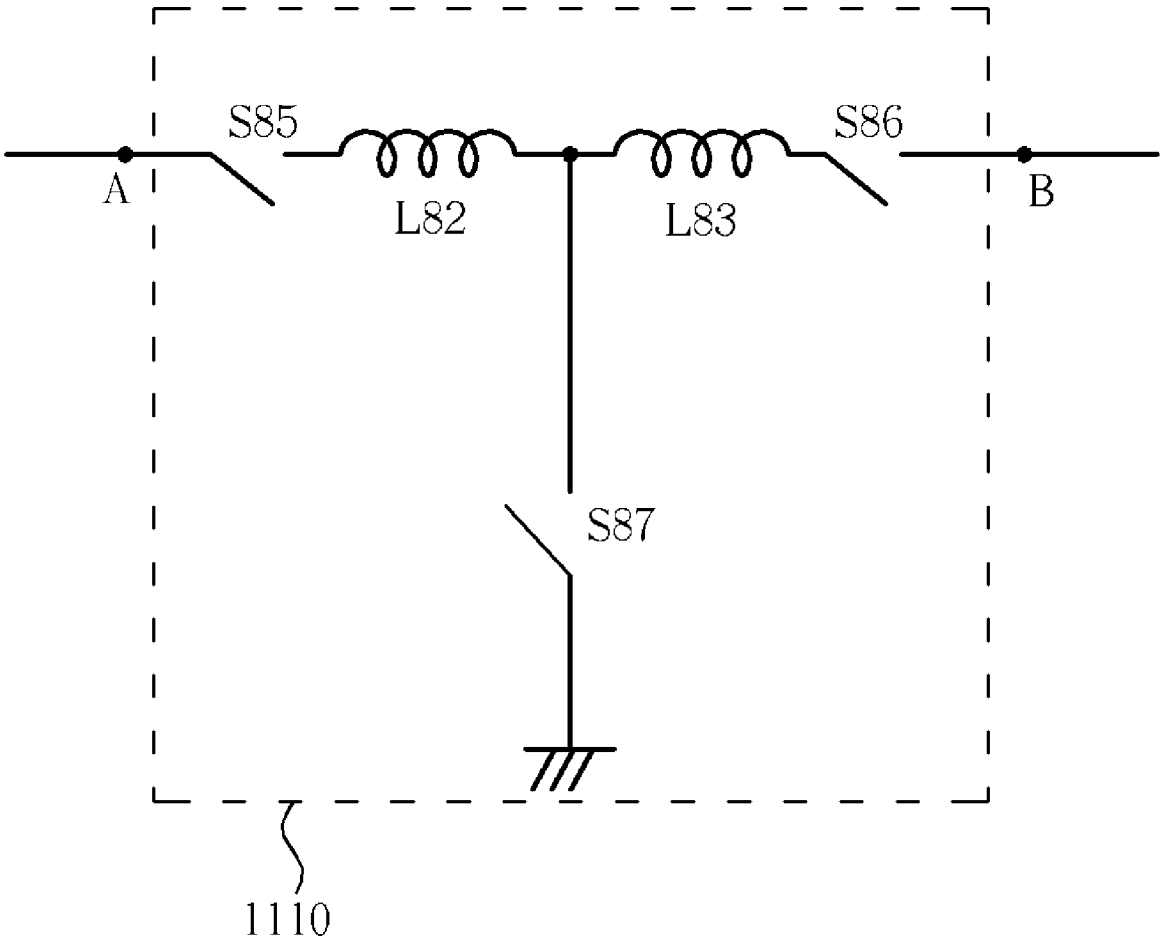
FIGS. 11-13 are a circuit diagrams of alternative energy recovery circuits for use with the present invention.

Please refer to FIG. 11. FIG. 11 is a circuit diagram of energy recovery circuit 1110. Energy recovery circuits 410, 510, 610, 810, and 910 shown in FIGS. 4-6 and 8-9 can be replaced by energy recovery circuit 1110 in FIG. 11 for changing the slopes of sustain waveforms of the X side and the Y side. The energy recovery circuit 1110 contains switches S85, S86, and S87 and inductors L82 and L83.

Inductor L82 and switch S85 couple in series and inductor L83 and switch S86 couple in series. The slopes of the X side and the Y side can be adjusted by adjusting the properties of the inductors L82 and L83, respectively.

Figure 12:
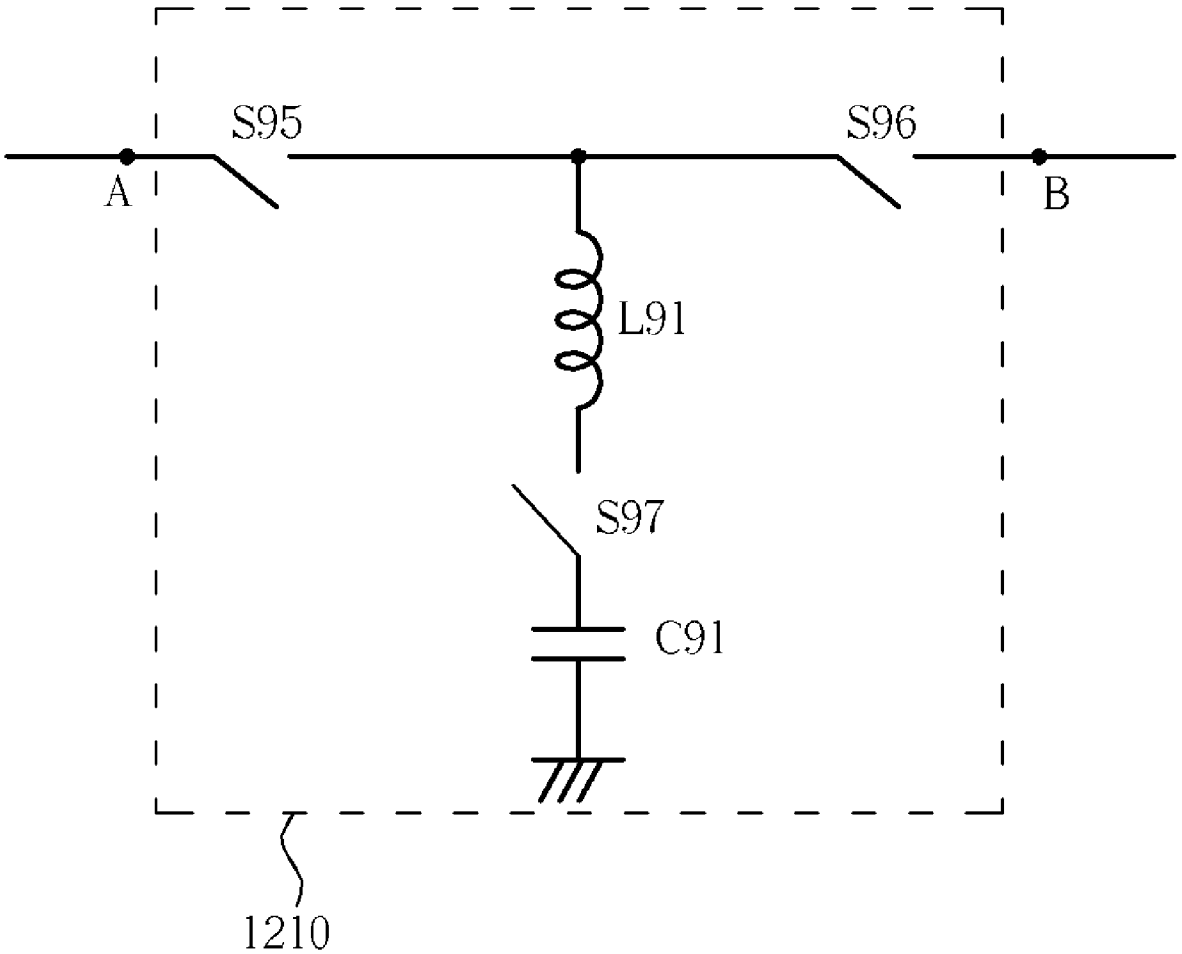
Figure 13:
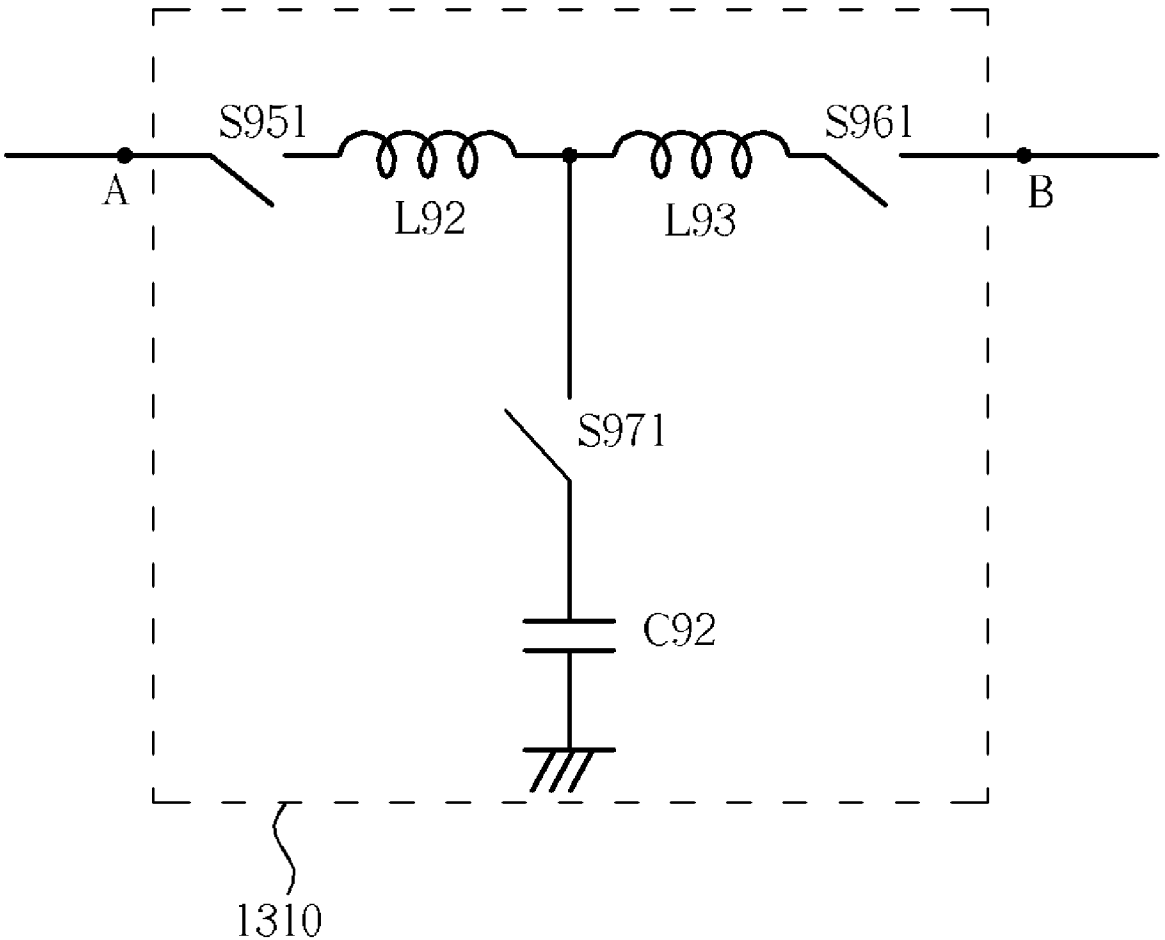

Please refer to FIG. 12 and FIG. 13. If the voltage potentials of V3 and V4 are ground, the energy recovery circuits 410, 510, 610, 810, 910, and 1110 should instead be replaced by energy recovery circuit 1210 or 1310. The energy recovery circuit 1210 contains switches S95, S96, and S97, inductor L91, and capacitor C91. Inductor L91, switch S97, and capacitor C91 couple in series. The energy recovery circuit 1310 contains switches S951, S961 and S971, inductors L92 and L93, and capacitor C92. Switch S951 and inductor L92 couple in series, switch S961 and inductor L93 couple in series, and switch S971 and capacitor C92 couple in series.

Please note that the waveforms shown in FIG. 7 and FIG. 10 are merely two examples of waveforms that can be produced according to the present invention. Other waveforms could also be produced by rearranging the order in which the various switches are turned on and off. The scan ICs of the present invention switch use soft switching at all times except during the scanning period.

The present invention can also be implemented by connecting two or more switches in parallel for sharing current. For example, switch S61 in FIG. 9 can be composed of two n-channel MOSFETs electrically connected in parallel for sharing the current. These two n-channel MOSFETs can be designed to create different slopes.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A plasma display panel driving circuit comprising:

a panel equivalent capacitor having a first side and a second side;

a first switch electrically connected between a first voltage source and the first side of the panel equivalent capacitor;

a second switch electrically connected between a second voltage source and a first node;

a third switch electrically connected between a third voltage source and the first side of the panel equivalent capacitor;

a fourth switch electrically connected between a fourth voltage source and the first node;

an energy recovery circuit electrically connected between the first side of the panel equivalent capacitor and the first node;

a fifth switch electrically connected between the first node and a second node;

a sixth switch electrically connected between a fifth voltage source and the second node;

a sixth voltage source electrically connected between the second node and a third node; and a scan IC comprising:

a high-side switch electrically connected between the third node and the second side of the panel equivalent capacitor; and a low-side switch electrically connected between the second side of the panel equivalent capacitor and the second node.

2. The plasma display panel driving circuit of claim 1, wherein voltages produced by the first and second voltage sources are greater than those produced by the third, fourth, and fifth voltage sources.

3. The plasma display panel driving circuit of claim 2, wherein the voltage produced by the fourth voltage source is greater than the voltage produced by the fifth voltage source, and the voltage produced by the fourth voltage source is less than the sum of the voltage produced by the fifth voltage source and the voltage supplied by the sixth voltage source.

4. The plasma display panel driving circuit of claim 3, wherein the energy recovery circuit comprises:

a seventh switch electrically connected between the first side of the panel equivalent capacitor and a central node;

an eighth switch electrically connected between the first node and the central node; and an inductor and a ninth switch electrically connected in series between the central node and ground.

5. The plasma display panel driving circuit of claim 4, wherein the inductor is electrically connected between the central node and the ninth switch, and the ninth switch is electrically connected between the inductor and ground.

6. The plasma display panel driving circuit of claim 3, wherein the energy recovery circuit comprises:

a seventh switch and a first inductor electrically connected in series between the first side of the panel equivalent capacitor and a central node;

an eighth switch and a second inductor electrically connected in series between the first node and the central node; and a ninth switch electrically connected between the central node and ground.

7. The plasma display panel driving circuit of claim 6, wherein the seventh switch is electrically connected between the first side of the panel equivalent capacitor and the first inductor, the first inductor is electrically connected between the seventh switch and the central node, the eighth switch is electrically connected between the first node and the second inductor, and the second inductor is electrically connected between the eighth switch and the central node.

8. The plasma display panel driving circuit of claim 3, wherein the third and fourth voltage sources are ground and the energy recovery circuit comprises:

a seventh switch electrically connected between the first side of the panel equivalent capacitor and a central node;

an eighth switch electrically connected between the first node and the central node; and an inductor, a ninth switch, and a capacitor electrically connected in series between the central node and ground.

9. The plasma display panel driving circuit of claim 8, wherein the inductor is electrically connected between the central node and the ninth switch, the ninth switch is electrically connected between the inductor and the capacitor, and the capacitor is electrically connected between the ninth switch and ground.

10. The plasma display panel driving circuit of claim 3, wherein the third and fourth voltage sources are ground and the energy recovery circuit comprises:

a seventh switch and a first inductor electrically connected in series between the first side of the panel equivalent capacitor and a central node;

an eighth switch and a second inductor electrically connected in series between the first node and the central node; and a ninth switch and a capacitor electrically connected in series between the central node and ground.

11. The plasma display panel driving circuit of claim 10, wherein the seventh switch is electrically connected between the first side of the panel equivalent capacitor and the first inductor, the first inductor is electrically connected between the seventh switch and the central node, the eighth switch is electrically connected between the first node and the second inductor, the second inductor is electrically connected between the eighth switch and the central node, the ninth switch is electrically connected between the central node and the capacitor, and the capacitor is electrically connected between the ninth switch and ground.

12. A plasma display panel driving circuit comprising:

a panel equivalent capacitor having a first side and a second side;

a first switch electrically connected between a first voltage source and the first side of the panel equivalent capacitor;

an energy recovery circuit electrically connected between the first side of the panel equivalent capacitor and a first node;

a second switch electrically connected between a second voltage source and a second node;

a third switch electrically connected between a third voltage source and the first side of the panel equivalent capacitor;

a fourth switch electrically connected between a fourth voltage source and the first node;

a fifth switch electrically connected between a fifth voltage source and the second node;

a sixth voltage source electrically connected between the second node and a third node; and a scan IC comprising:

a high-side switch electrically connected between the third node and the second side of the panel equivalent capacitor; and a low-side switch electrically connected between the second side of the panel equivalent capacitor and the second node.

13. The plasma display panel driving circuit of claim 12, wherein voltages produced by the first and second voltage sources are greater than voltage produced by the third, fourth, and fifth voltage sources.

14. The plasma display panel driving circuit of claim 13, wherein the voltage produced by the fourth voltage source is greater than the voltage produced by the fifth voltage source, and the voltage produced by the fourth voltage source is less than the sum of the voltage produced by the fifth voltage source and the voltage supplied by the sixth voltage source.

15. The plasma display panel driving circuit of claim 14, wherein the energy recovery circuit comprises:

a sixth switch electrically connected between the first side of the panel equivalent capacitor and a central node;

a seventh switch electrically connected between the first node and the central node; and an inductor and an eighth switch electrically connected in series between the central node and ground.

16. The plasma display panel driving circuit of claim 15, wherein the inductor is electrically connected between the central node and the eighth switch, and the eighth switch is electrically connected between the inductor and ground.

17. The plasma display panel driving circuit of claim 14, wherein the energy recovery circuit comprises:

a sixth switch and a first inductor electrically connected in series between the first side of the panel equivalent capacitor and a central node;

a seventh switch and a second inductor electrically connected in series between the first node and the central node; and an eighth switch electrically connected between the central node and ground.

18. The plasma display panel driving circuit of claim 17, wherein the sixth switch is electrically connected between the first side of the panel equivalent capacitor and the first inductor, the first inductor is electrically connected between the sixth switch and the central node, the seventh switch is electrically connected between the first node and the second inductor, and the second inductor is electrically connected between the seventh switch and the central node.

19. The plasma display panel driving circuit of claim 14, wherein the third and fourth voltage sources are ground and the energy recovery circuit comprises:

a sixth switch electrically connected between the first side of the panel equivalent capacitor and a central node;

a seventh switch electrically connected between the first node and the central node; and an inductor, an eighth switch, and a capacitor electrically connected in series between the central node and ground.

20. The plasma display panel driving circuit of claim 19, wherein the inductor is electrically connected between the central node and the eighth switch, the eighth switch is electrically connected between the inductor and the capacitor, and the capacitor is electrically connected between the eighth switch and ground.

21. The plasma display panel driving circuit of claim 14, wherein the third and fourth voltage sources are ground and the energy recovery circuit comprises:

a sixth switch and a first inductor electrically connected in series between the first side of the panel equivalent capacitor and a central node;

a seventh switch and a second inductor electrically connected in series between the first node and the central node; and an eighth switch and a capacitor electrically connected in series between the central node and ground.

22. The plasma display panel driving circuit of claim 21, wherein the sixth switch is electrically connected between the first side of the panel equivalent capacitor and the first inductor, the first inductor is electrically connected between the sixth switch and the central node, the seventh switch is electrically connected between the first node and the second inductor, the second inductor is electrically connected between the seventh switch and the central node, the eighth switch is electrically connected between the central node and the capacitor, and the capacitor is electrically connected between the eighth switch and ground.

* * * * *